US010519854B2

(12) United States Patent
Lineton et al.

(10) Patent No.: US 10,519,854 B2
(45) Date of Patent: Dec. 31, 2019

(54) THERMALLY INSULATED ENGINE COMPONENTS AND METHOD OF MAKING USING A CERAMIC COATING

(71) Applicant: FEDERAL-MOGUL CORPORATION, Southfield, MI (US)

(72) Inventors: Warran Boyd Lineton, Chelsea, MI (US); Miguel Azevedo, Ann Arbor, MI (US); Greg Salenbien, Britton, MI (US)

(73) Assignee: Tenneco Inc., Lake Forest, IL (US)

( * ) Notice: Subject to any disclaimer, the term of this patent is extended or adjusted under 35 U.S.C. 154(b) by 142 days.

(21) Appl. No.: 15/354,080

(22) Filed: Nov. 17, 2016

(65) Prior Publication Data

US 2017/0145914 A1 May 25, 2017

Related U.S. Application Data

(60) Provisional application No. 62/257,993, filed on Nov. 20, 2015.

(51) Int. Cl.

| | |
|---|---|
| ***F02B 77/11*** | (2006.01) |
| ***C23C 4/126*** | (2016.01) |
| ***C23C 4/10*** | (2016.01) |

(52) U.S. Cl.

CPC ..... *F02B 77/11* (2013.01); *C23C 4/10* (2013.01); *C23C 4/126* (2016.01)

(58) Field of Classification Search

CPC ..... F02B 77/11; C23C 4/073; C23C 4/126

See application file for complete search history.

(56) References Cited

U.S. PATENT DOCUMENTS

| | | | |
|---|---|---|---|
| 1,391,106 | A | 9/1921 | Guibert |
| 1,462,654 | A | 7/1923 | Philip |

(Continued)

FOREIGN PATENT DOCUMENTS

| | | | |
|---|---|---|---|
| CA | 2159232 | A1 | 3/1996 |
| CA | 2440804 | A1 | 3/2005 |

(Continued)

OTHER PUBLICATIONS

Poola, R. B. (1994). Performance of Thin-Ceramic-Coated Combustion Chamber with Gasoline and Methanol as Fuels in a Two-Stroke SI Engine. Madras, India: Argonne National Laboratory. (Year: 1994).*

(Continued)

*Primary Examiner* — Kevin A Lathers

(74) *Attorney, Agent, or Firm* — Robert L. Stearns; Dickinson Wright, PLLC

(57) ABSTRACT

A component for exposure to a combustion chamber of a diesel engine and/or exhaust gas, such as a cylinder liner or valve face, is provided. The component includes a thermal barrier coating applied to a body portion formed of steel. A layer of a metal bond material is first applied, followed by a gradient structure including a mixture of the metal bond material and a ceramic material, followed by a layer of the ceramic material. The ceramic material includes at least one of ceria, ceria stabilized zirconia, yttria stabilized zirconia, calcia stabilized zirconia, magnesia stabilized zirconia, and zirconia stabilized by another oxide. The thermal barrier coating is applied by thermal spray or HVOF. The thermal barrier coating has a porosity of 2% by vol. to 25% vol., a thickness of less than 1 mm, and a thermal conductivity of less than 1.00 W/m·K.

28 Claims, 5 Drawing Sheets

(56) References Cited

U.S. PATENT DOCUMENTS

| | | | | |
|---|---|---|---|---|
| 1,508,099 | A | 9/1924 | Hawley, Jr. | |
| 1,559,439 | A | 10/1925 | Kapraun | |
| 1,605,838 | A | 11/1926 | Hawley, Jr. | |
| 1,869,077 | A | 7/1932 | Prentice | |
| 2,600,440 | A | 6/1952 | Smith | |
| 2,926,649 | A | 3/1960 | Hicks | |
| 3,552,370 | A | 1/1971 | Briggs | |
| 3,820,523 | A | 6/1974 | Showalter et al. | |
| 3,911,891 | A | 10/1975 | Dowell | |
| 3,976,809 | A | 8/1976 | Dowell | |
| 4,074,671 | A | 2/1978 | Pennila | |
| 4,138,984 | A | 2/1979 | Steidle et al. | |
| 4,471,017 | A | 9/1984 | Poeschel et al. | |
| 4,645,440 | A | 2/1987 | Murata et al. | |
| 4,645,716 | A | 2/1987 | Harrington et al. | |
| 4,694,813 | A | 9/1987 | Mielke | |
| 4,711,208 | A | 12/1987 | Sander et al. | |
| 4,719,089 | A | 1/1988 | Gardner | |
| 4,738,227 | A | 4/1988 | Kamo et al. | |
| 4,742,030 | A | 5/1988 | Masaki et al. | |
| 4,770,133 | A | 9/1988 | Schibalsky | |
| 4,811,701 | A | 3/1989 | Buhl et al. | |
| 4,852,542 | A | 8/1989 | Kamo et al. | |
| 4,891,343 | A | 1/1990 | Quadair | |
| 4,977,114 | A | 12/1990 | Horinouchi et al. | |
| 4,980,321 | A | 12/1990 | Tsujimura | |
| 5,014,605 | A | 5/1991 | Santi | |
| 5,058,488 | A | 10/1991 | Cullen et al. | |
| 5,169,674 | A | 12/1992 | Miller | |
| 5,175,132 | A | 12/1992 | Ketcham | |
| 5,236,787 | A | 8/1993 | Grassi | |
| 5,240,741 | A | 8/1993 | Edwards, III et al. | |
| 5,305,726 | A * | 4/1994 | Scharman | C23C 4/02 123/193.6 |
| 5,320,909 | A | 6/1994 | Scharman et al. | |
| 5,384,200 | A | 1/1995 | Giles et al. | |
| 5,477,820 | A | 12/1995 | Rao | |
| 5,658,837 | A | 8/1997 | Quadair | |
| 5,705,231 | A | 1/1998 | Nissley et al. | |
| 5,713,324 | A | 2/1998 | Frame et al. | |
| 5,722,379 | A | 3/1998 | Binder et al. | |
| 5,805,973 | A | 9/1998 | Coffinberry et al. | |
| 5,900,283 | A | 5/1999 | Vakil et al. | |
| 5,985,368 | A | 11/1999 | Sangeeta et al. | |
| 5,987,882 | A * | 11/1999 | Voss | B01D 53/944 123/670 |
| 6,145,763 | A | 11/2000 | Fleming et al. | |
| 6,337,459 | B1 | 1/2002 | Terwijn et al. | |
| 6,606,983 | B2 | 8/2003 | Bedwell et al. | |
| 6,656,600 | B2 | 12/2003 | Strangman et al. | |
| 6,723,674 | B2 | 4/2004 | Wang et al. | |
| 6,877,473 | B2 | 4/2005 | Bischofberger et al. | |
| 6,886,548 | B2 | 5/2005 | Suck et al. | |
| 7,383,806 | B2 | 6/2008 | Abi-Akar et al. | |
| 7,383,807 | B2 | 6/2008 | Azevedo et al. | |
| 7,458,358 | B2 | 12/2008 | Lineton et al. | |
| 7,556,840 | B2 | 7/2009 | Altin | |
| 7,566,472 | B2 | 7/2009 | Coudurier | |
| 7,793,631 | B2 | 9/2010 | Niwa | |
| 7,859,100 | B2 | 12/2010 | Torigoe et al. | |
| 8,053,089 | B2 | 11/2011 | Margolies et al. | |
| 8,272,843 | B1 | 9/2012 | Ryznic et al. | |
| 8,505,513 | B2 | 8/2013 | Kashdan | |
| 8,535,779 | B1 | 9/2013 | Smith et al. | |
| 8,574,704 | B2 | 11/2013 | Smith et al. | |
| 8,863,720 | B2 | 10/2014 | Lineton | |
| 8,925,534 | B2 | 1/2015 | Bachmann et al. | |
| 9,115,659 | B2 | 8/2015 | Lorenz et al. | |
| 9,163,579 | B2 | 10/2015 | Aharonov et al. | |
| 9,194,280 | B2 | 11/2015 | Berkemeier et al. | |
| 2003/0084858 | A1 | 5/2003 | Kracklauer | |
| 2003/0196547 | A1 | 10/2003 | Bischofberger et al. | |
| 2005/0056007 | A1 | 3/2005 | Bourgon | |
| 2006/0219598 | A1 | 10/2006 | Cody et al. | |
| 2007/0000468 | A1 | 1/2007 | Azevedo et al. | |
| 2007/0113802 | A1 | 5/2007 | Mihara | |
| 2008/0072790 | A1 | 3/2008 | Ma et al. | |
| 2008/0073063 | A1 | 3/2008 | Clavenna et al. | |
| 2008/0131608 | A1 | 6/2008 | Torigoe et al. | |
| 2008/0167403 | A1 | 7/2008 | Burkle | |
| 2008/0311306 | A1 | 12/2008 | Xiao et al. | |
| 2009/0162670 | A1 | 6/2009 | Lau et al. | |
| 2009/0307967 | A1 | 12/2009 | Gardener et al. | |
| 2010/0081569 | A1 | 4/2010 | Sepeur et al. | |
| 2011/0048017 | A1 | 3/2011 | Margolies et al. | |
| 2012/0048227 | A1 | 3/2012 | Tricoire | |
| 2013/0025561 | A1 | 1/2013 | Gabriel et al. | |
| 2013/0133609 | A1 | 5/2013 | Matsuo | |
| 2013/0244025 | A1 | 9/2013 | Smith et al. | |
| 2013/0298531 | A1 | 11/2013 | Yokoyama | |
| 2014/0230776 | A1 * | 8/2014 | Balendra | F02B 53/00 123/200 |
| 2014/0251255 | A1 | 9/2014 | Beerens et al. | |
| 2014/0326224 | A1 | 11/2014 | Malfa et al. | |
| 2015/0017044 | A1 | 1/2015 | Steinwandel et al. | |
| 2015/0064376 | A1 | 3/2015 | Smith et al. | |
| 2015/0104626 | A1 | 4/2015 | Tomita et al. | |
| 2015/0114373 | A1 | 4/2015 | Beasley | |
| 2016/0047284 | A1 | 2/2016 | Turgeon et al. | |
| 2017/0145952 | A1 | 5/2017 | Lineton et al. | |
| 2017/0241371 | A1 | 8/2017 | Schneider | |
| 2017/0268457 | A1 | 9/2017 | Azevedo et al. | |

FOREIGN PATENT DOCUMENTS

| | | | | |
|---|---|---|---|---|
| CA | 2576004 | A1 | 9/2007 | |
| CA | 2529781 | C | 10/2010 | |
| CN | 202531299 | U | 11/2012 | |
| DE | 3038235 | A1 | 5/1982 | |
| DE | 3346969 | A1 | 7/1985 | |
| DE | 10029810 | A1 | 12/2001 | |
| DE | 10108834 | A1 | 9/2002 | |
| DE | 102007016946 | A1 | 10/2008 | |
| DE | 2007026746 | A1 | 12/2008 | |
| DE | 202011107284 | U1 | 1/2012 | |
| DE | 102012216929 | A1 | 3/2014 | |
| EP | 0093486 | A1 | 11/1983 | |
| EP | 0282490 | A4 | 12/1988 | |
| EP | 0816528 | A1 | 1/1998 | |
| EP | 0874066 | B1 | 8/2002 | |
| EP | 1674663 | A2 | 6/2006 | |
| EP | 1840238 | A2 | 10/2007 | |
| EP | 1898065 | A1 | 3/2008 | |
| EP | 2096290 | A1 | 9/2009 | |
| EP | 1959099 | B1 | 6/2011 | |
| EP | 2371987 | A2 | 10/2011 | |
| GB | 1296967 | A | 11/1972 | |
| JP | 55019903 | A * | 2/1980 | F02F 1/18 |
| JP | S58195050 | A | 11/1983 | |
| JP | S61142320 | A | 6/1986 | |
| JP | S61218715 | A | 9/1986 | |
| JP | H04191413 | A | 7/1992 | |
| JP | H09209830 | A | 8/1997 | |
| JP | 2006112422 | A | 4/2006 | |
| KR | 20100061432 | A | 6/2010 | |
| KR | 20130004709 | A | 1/2013 | |
| RU | 2309271 | C2 | 10/2007 | |
| WO | WO8802061 | A1 | 3/1988 | |
| WO | WO8903930 | A1 | 5/1989 | |
| WO | WO9313245 | A1 | 7/1993 | |
| WO | WO9942710 | A1 | 8/1999 | |
| WO | WO2006076161 | A1 | 7/2006 | |
| WO | WO2010078463 | A1 | 7/2010 | |
| WO | WO2012087550 | A1 | 6/2012 | |
| WO | WO2015134162 | A1 | 9/2015 | |
| WO | 2017087733 | A1 | 5/2017 | |
| WO | 2017087734 | A1 | 5/2017 | |
| WO | 2017160896 | A1 | 9/2017 | |

OTHER PUBLICATIONS

Sivakumar, G., & Senthil Kumar, S. (Sep. 23, 2014). Investigation on effect of Yttria Stabilized Zirconia coated piston crown on

(56) References Cited

OTHER PUBLICATIONS performance and emission characteristics of a diesel engine. Retrieved from https://www.sciencedirect.com/science/article/pii/S111001681400088X (Year: 2014).*

Ahmadi-Pidani, R. et al., "Improving the hot corrosion resistance of plasma sprayed ceria-yttria stabilized zirconia thermal barrier coatings by laser surface treatment", Materials and Design, vol. 57 (2014), pp. 336-341.

Brindley, W. et al., "Thermal Barrier Coating Evaluation Needs", NASA Technical Memorandum 103708, Conference on Nondestructive Evaluation of Modern Ceramics, Columbus, OH, Jul. 9-12, 1990.

Buyukkaya, E. et al., "Effects of thermal barrier coating on gas emissions and performance of a LHR engine with different injection timings and valve adjustment", Energy Conversion and Management, vol. 47, Issues 9-10 (2006), pp. 1298-1310.

Carmona, D., "Thermal barrier coatings for efficient combustion", KTH Industrial Engineering and Management, Degree Project in Materials Science and Engineering, Second Cycle, Stockholm, Sweden, 2014.

Ciniviz, M. et al., "Ceramic Coating Applications and Research Fields for Internal Combustion Engines, Ceramic Coatings—Applications in Engineering", Prof. Feng Shi (Ed.), InTech, Feb. 2012, pp. 195-234, doi: 10.5772/29993; available from http://www.intechopen.com/books/ceramic-coatings-applications-in-engineering/ceramic-coating-applications-and-research-fields-for-internal-combusion-engines.

Dickey, D., "The Effect of Insulated Combustion Chamber Surfaces on Direct-Injected Diesel Engine Performance, Emissions and Combustion", SAE Technical Paper 890292, 1989, doi:10.4271/890292.

Jech, D. et al., "Structural Stability of Plasma Sprayed CoNiCrAlY—ZiO2+Y2O3 Thermal Barrier Coatings After Isothermal Exposure at 1050° C.", 22nd International Conference on Metallurgy and Materials (METAL), Brno, Czech Republic, May 2013.

Lee, J. et al, "Microstructure and thermal cyclic performance of laser-glazed plasma-sprayed ceria-yttria-stabilized zirconia thermal barrier coatings", Surface & Coatings Technology, vol. 202 (2008), pp. 5607-5612.

Levy, A. et al., "The Behavior of Ceramic Thermal Barrier Coatings on Diesel Engine Combustion Zone Components", Surface and Coatings Technology, vol. 30 (1987), pp. 51-61.

Modi, A., "Experimental Study of Energy Balance in Thermal Barrier Coated Diesel Engine", SAE Technical Paper 2012-01-0389, 2012, doi:10.4271/2012-01-0389.

Palaniswamy, E. et al, "Ceramic Coated Combustion Chamber for Improving IC Engine Performance", International Journal on Design and Manufacturing Technologies, vol. 2, No. 1, Jul. 2008, pp. 22-25.

Pandian, S. et al., "Thermal and Structural Analysis of Functionally Graded NiCrAlY/YSZ/Al2O3 Coated Piston", SAE Technical Paper 2015-01-9081, 2015, doi:10.4271/2015-01-9081.

Rupangudi, S. et al., "Study of Effect of Coating of Piston on the Performance of a Diesel Engine", SAE Technical Paper 2014-01-1024, 2014, doi: 10.4271/2014-01-1021.

Soltic, P. et al., "Catalytic Piston Coating", Conference Paper, 5. Conference on Gas Powered Vehicles, Berlin, Germany, Sep. 2010.

Winkler, M. et al, "Thermal Barrier Coatings for Diesel Engines: Ten Years of Experience", SAE Technical Paper 922438, 1992, doi:10.4271/922438.

Oerlikon Metco Material Product Data Sheet, Ceria-Yttria Stabilized Zirconium Oxide HOSP Powder, DSMTS-0038.1, 2014.

International Search Report, dated Feb. 20, 2017 (PCT/US2016/062648).

Jalaludin Helmisyah Ahmad et al, Experimental Study of Ceramic Coated Piston Crown for Compressed Natural Gas Direct Injection Engines, Procedia Engineering, vol. 68, Nov. 18, 2013, pp. 505-511 (Sections 2.1,3.1; Figure 2; Table 1).

International Search Report, dated Feb. 8, 2017 (PCT/US2016/062649).

Khor et al., Plasma sprayed functionally graded thermal barrier coatings, Materials Letters, North Holland Publishing Company, Amsterdam, NL, vol. 38, No. 6, Mar. 18, 1999, pp. 437-444 (Sections 1-3.2; Tables 3-5).

Chunxu Pan et al., Microstructural characteristics in plasma sprayed functionally graded ZrO2/NiCrAl coatings, vol. 162, No. 2-3, Jan. 20, 2003, pp. 194-201 (Sections 1-3.1; Tables 1, 2).

Oerlikon Metco: Thermal Spray Poweder Products: Ceria-Yttria Stabilized Zirconium Oxide HOSP Powder, Aug. 12, 2014, pp. 1-3, retrieved from the Internet Jan. 16, 2017: https://www.oerlikon.com/ecomaXL/files/oerlikon_DSMTS-0038.1_CeZrO.pdf&download=1.

International Search Report, dated Jan. 22, 2019 (PCT/US2018/057661).

* cited by examiner

EXAMPLE 1:
50wt% ceramic/25wt% mix/25wt% bond consisting of CSZ/CSZ+bond/bond

| Layer | Component | % by mass |
|---|---|---|
| Top | CSZ | 50.0 |
| | YSZ | 0.0 |
| Mid | CSZ | 12.5 |
| | YSZ | 0.0 |
| | Bond | 12.5 |
| Bond | Bond only | 25.0 |

EXAMPLE 2:
50wt% ceramic/25wt% mix/25wt% bond consisting of (mix CSZ/YSZ)/(CSZ/YSZ)+bond/bond

| Layer | Component | % by mass |
|---|---|---|
| Top | CSZ | 25.0 |
| | YSZ | 25.0 |
| Mid | CSZ | 6.3 |
| | YSZ | 6.3 |
| | Bond | 12.5 |
| Bond | Bond only | 25.0 |

FIG. 5B

EXAMPLE 3:
50wt% ceramic/25wt% mix/25wt% bond consisting of YSZ/YSZ+bond/bond

| Layer | Component | % by mass |
|---|---|---|
| Top | CSZ | 0.0 |
| | YSZ | 50.0 |
| Mid | CSZ | 0.0 |
| | YSZ | 12.5 |
| | Bond | 12.5 |
| Bond | Bond only | 25.0 |

FIG. 5C

EXAMPLE 4:
Five layer coating transitioning from 100% bond to 100% ceramic

| Layer | Composition by mass % |
|---|---|
| Top CSZ | 20% of total coating, 100;0 CSZ:bond |
| Layer 4 | 20% of total coating, 75;25 CSZ:bond |
| Layer 3 | 20% of total coating, 50;50 CSZ:bond |
| Layer 2 | 20% of total coating, 25;75 CSZ:bond |
| Bond | 20% of total coating, 0;100 CSZ:bond |

FIG. 5D

THERMALLY INSULATED ENGINE COMPONENTS AND METHOD OF MAKING USING A CERAMIC COATING

CROSS-REFERENCE TO RELATED APPLICATIONS

This U.S. utility patent application claims the benefit of U.S. provisional patent application No. 62/257,993, filed Nov. 20, 2015, the entire contents of which are incorporated herein by reference.

BACKGROUND OF THE INVENTION

1. Field of the Invention

This invention relates generally to internal combustion engines, including insulated components exposed to combustion chambers and/or exhaust gas of diesel engines, and methods of manufacturing the same.

2. Related Art

Modern heavy duty diesel engines are being pushed towards increased efficiency under emissions and fuel economy legislation. To achieve greater efficiency, the engines must run hotter and at higher peak pressures. Thermal losses through the combustion chamber become problematic under these increased demands. Typically, about 4% to 6% of available fuel energy is lost as heat through the piston into the cooling system. One way to improve engine efficiency is to extract energy from hot combustion gases by turbo-compounding. For example, about 4% to 5% of fuel energy can be extracted from the hot exhaust gases by turbo-compounding.

Another way to improve engine efficiency includes reducing heat losses to the cooling system by insulating components of the engine, for example using insulating layers formed of ceramic materials. One option includes applying a metal bonding layer to a metal surface followed by a ceramic layer. However, the layers are discrete and the ceramic is by its nature porous. Thus, combustion gases can pass through the ceramic and start to oxidize the metal bonding layer at the ceramic/bonding layer interface, causing a weak boundary layer to form and potential failure of the coating over time. In addition, mismatches in thermal expansion coefficients between adjacent layers, and the brittle nature of ceramics, create the risk for delamination and spalling.

Another example is a thermally sprayed coating formed of yttria stabilized zirconia. This material, when used alone, can suffer destabilization through thermal effects and chemical attack in diesel combustion engines. It has also been found that thick ceramic coatings, such as those greater than 500 microns, for example 1 mm, are prone to cracking and failure. Typical aerospace coatings used for jet turbines are oftentimes not suitable because of raw material and deposition costs associated with the highly cyclical nature of the thermal stresses imposed.

SUMMARY OF THE INVENTION

One aspect of the invention provides a component for exposure to a combustion chamber of an internal combustion engine, such as a diesel engine, and/or exhaust gas generated by the internal combustion engine. The component comprises a body portion formed of metal, and a thermal barrier coating applied to the body portion. The thermal barrier coating has a thickness extending from the metal body portion to a top surface. The thermal barrier coating includes a mixture of a metal bond material and a ceramic material, and the amount of ceramic material present in the thermal barrier coating increases from the body portion to the top surface.

Another aspect of the invention provides a method of manufacturing a component for exposure to a combustion chamber of an internal combustion engine and/or exhaust gas generated by the internal combustion engine. The method includes applying a thermal barrier coating to a body portion formed of metal. The thermal barrier coating has a thickness extending from the body portion to a top surface, and the thermal barrier coating includes a mixture of a metal bond material and a ceramic material. The step of applying the thermal barrier coating to the body portion includes increasing the amount of ceramic material relative to the metal bond material from the body portion to the top surface.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 discloses example compositions of the thermal barrier coating; and

DETAILED DESCRIPTION OF EXAMPLE EMBODIMENTS

One aspect of the invention provides a component of an internal combustion engine 20, such as a heavy duty diesel engine, including a thermal barrier coating 22. The thermal barrier coating 22 prevents heat from passing through the component, and thus can maintain heat in a desired area of the internal combustion engine 20, for example in a fuel-air mixture of a combustion chamber 24 or in exhaust gas, which improves engine efficiency. The thermal barrier coating 22 is also more cost effective and stable, as well as less susceptible to chemical attacks, compared to other coatings used to insulate engine components.

Figure 1:
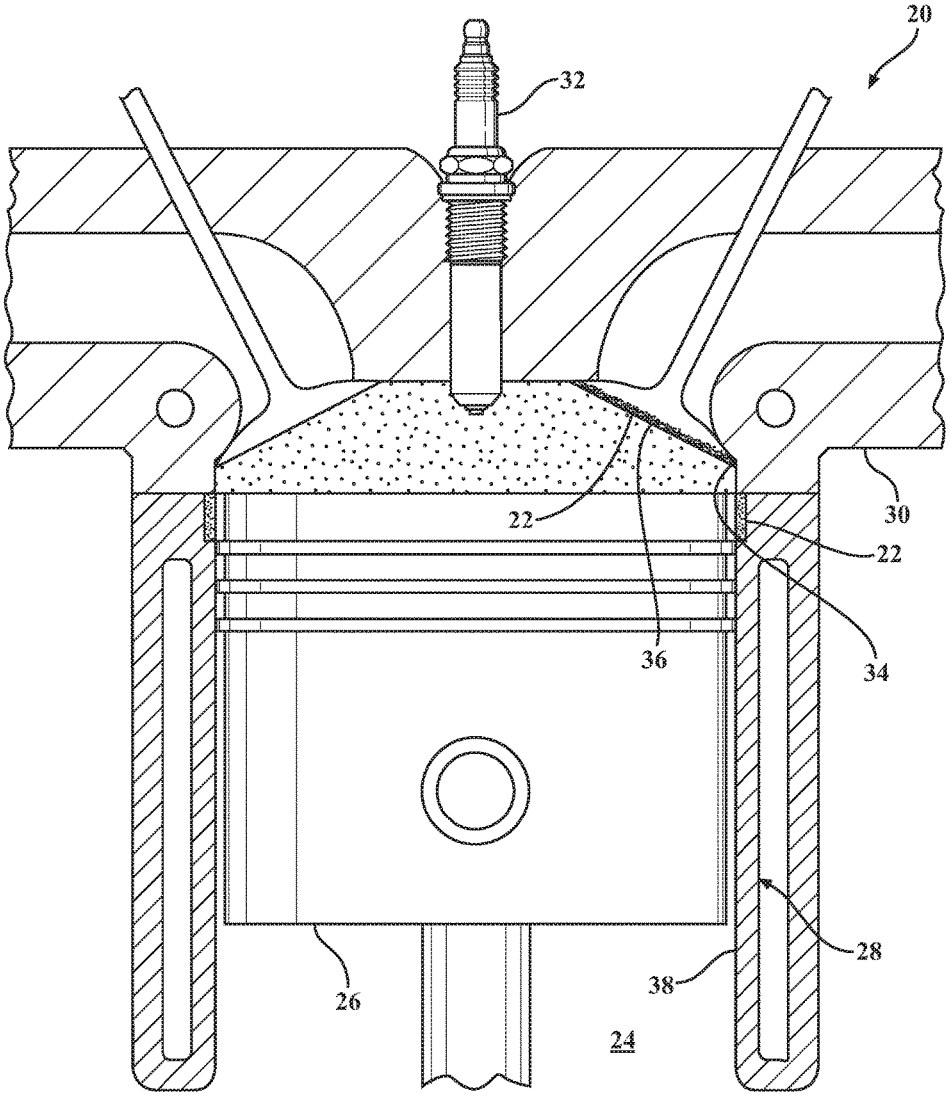
FIG. 1 is a side cross-sectional view of a combustion chamber of a diesel engine, wherein components exposed to the combustion chamber are coated with a thermal barrier coating according to an example embodiment of the invention.

Various different components of the internal combustion engine 20 can be coated with the thermal barrier coating 22. A corresponding U.S. patent application filed on the same day as the present application and claiming priority to the same provisional patent application No. 62/257,993 is directed to application of the thermal barrier coating 22 to a piston 26. However, as shown in FIG. 1, the thermal barrier coating 22 can be applied to one or more other components exposed to the combustion chamber 24, including a cylinder liner 28, cylinder head 30, fuel injector 32, valve seat 34, and valve face 36. Typically, the thermal barrier coating 22 is only applied to a portion of the component exposed to the combustion chamber 24. For example, an entire surface of the component exposed to the combustion chamber 24 could be coated. Alternatively, only a portion of the surface of the component exposed to the combustion chamber 24 is coated. The thermal barrier coating 22 could also be applied to select locations of the surface exposed to the combustion chamber 24, depending on the conditions of the combustion chamber 24 and location of the surface relative to other components.

Figure 2:
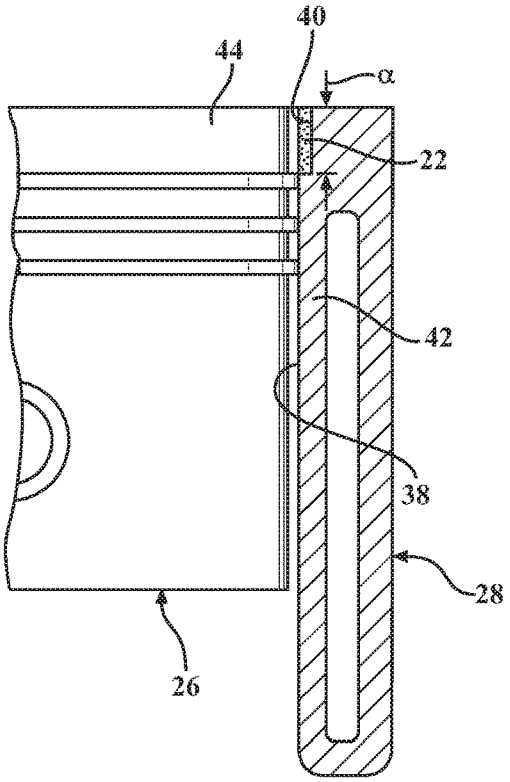
FIG. 2 is an enlarged view of a cylinder liner exposed to the combustion chamber of FIG. 1 with the thermal barrier coating applied to a portion of the cylinder liner.
Figure 3:
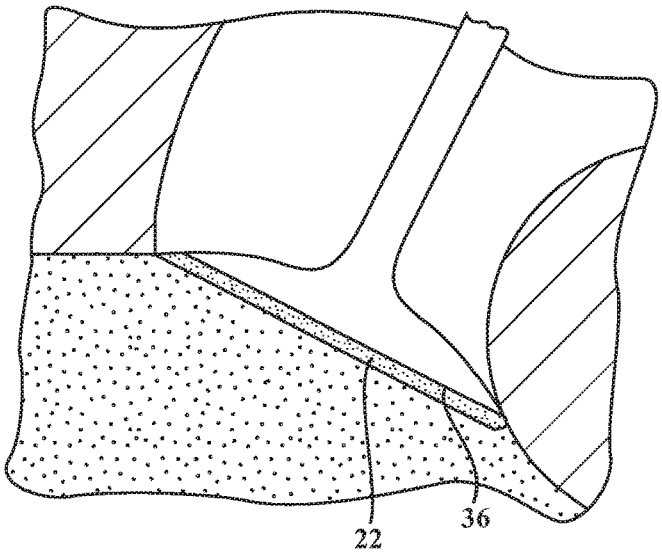
FIG. 3 is an enlarged view of a valve face exposed to the combustion chamber of FIG. 1 with the thermal barrier coating applied to the valve face.

In the example embodiment of FIG. 1, the thermal barrier coating 22 is only applied to a portion of an inner diameter surface 38 of the cylinder liner 28 located opposite a top land 44 of the piston 26 when the piston 26 is located at top dead center, and the thermal barrier coating 22 is not located at any other location along the inner diameter surface 38, and is not located at any contact surfaces of the cylinder liner 28. FIG. 2 is an enlarged view of the portion of the cylinder liner 28 including the thermal barrier coating 22. In this embodiment, the inner diameter surface 38 includes a groove 40 machined therein. The groove 40 extends along a portion of the length of the cylinder liner 28 from a top edge of the inner diameter surface 38, and the thermal barrier coating 22 is disposed in the groove 40. Also in this example, the length l of the groove 40 and the thermal barrier coating 22 is 5 mm to 10 mm wide. In other words, the thermal barrier coating 22 extends 5 mm to 10 mm along the length of the cylinder liner 28. In the example embodiment of FIG. 1, the thermal barrier coating 22 is also applied to the valve face 36. FIG. 3 is an enlarged view of the valve face 36 including the thermal barrier coating 22.

The thermal barrier coating 22 could also be applied to other components of the internal combustion engine 20, or components associated with the internal combustion engine 20, for example other components of a valvetrain, post-combustion chamber, exhaust manifold, and turbocharger. The thermal barrier coating 22 is typically applied to components of a diesel engine directly exposed to hot gasses of the combustion chamber 24 or exhaust gas, and thus high temperatures and pressures, while the engine 20 is running. A body portion 42 of the component is typically formed of steel, such as an AISI 4140 grade or a microalloy 38MnSiVS5, for example, or another metal material. Any steel used to form the body portion 42 does not include phosphate. If any phosphate is present on the surface of the body portion 42, then that phosphate is removed prior to applying the thermal barrier coating 22.

The thermal barrier coating 22 is applied to one or more components of the internal combustion engine 20 or exposed to exhaust gas generated by the internal combustion engine 20, to maintain heat in the combustion chamber 24 or in exhaust gas, and thus increase efficiency of the engine 20. The thermal barrier coating 22 is oftentimes disposed in specific locations, depending on patterns from heat map measurements, in order to modify hot and cold regions of the component. The thermal barrier coating 22 is designed for exposure to the harsh conditions of the combustion chamber 24. For example, the thermal barrier coating 22 can be applied to components of the diesel engine 20 subject to large and oscillating thermal cycles. Such components experience extreme cold start temperatures and can reach up to 700° C. when in contact with combustion gases. There is also temperature cycling from each combustion event of approximately 15 to 20 times a second or more. In addition, pressure swings up to 250 to 300 bar are seen with each combustion cycle.

A portion of the thermal barrier coating 22 is formed of a ceramic material 50, specifically at least one oxide, for example ceria, ceria stabilized zirconia, yttria stabilized zirconia, calcia stabilized zirconia, magnesia stabilized zirconia, zirconia stabilized by another oxide, and/or a mixture thereof. The ceramic material 50 has a low thermal conductivity, such as less than 1 W/m·K. When ceria is used in the ceramic material 50, the thermal barrier coating 22 is more stable under the high temperatures, pressures, and other harsh conditions of a diesel engine 20. The composition of the ceramic material 50 including ceria also makes the thermal barrier coating 22 less susceptible to chemical attack than other ceramic coatings, which can suffer destabilization when used alone through thermal effects and chemical attack in diesel combustion engines. Ceria and ceria stabilized zirconia are much more stable under such thermal and chemical conditions. Ceria has a thermal expansion coefficient which is preferably similar to the steel material used to form the body portions 42 of the components to which the thermal barrier coating 22 is applied. The thermal expansion coefficient of ceria at room temperature ranges from 10E-6 to 11E-6, and the thermal expansion coefficient of steel at room temperature ranges from 11E-6 to 14E-6. The similar thermal expansion coefficients help to avoid thermal mismatches that produce stress cracks.

Typically, the thermal barrier coating 22 includes the ceramic material 50 in an amount of 70 percent by volume (% by vol.) to 95% by vol., based on the total volume of the thermal barrier coating 22. In one embodiment, the ceramic material 50 used to form the thermal barrier coating 22 includes ceria in an amount of 90 to 100 wt. %, based on the total weight of the ceramic material 50. In another example embodiment, the ceramic material 50 includes ceria stabilized zirconia in an amount of 90 to 100 wt. %, based on the total weight of the ceramic material 50. In another example embodiment, the ceramic material 50 includes yttria stabilized zirconia in an amount of 90 to 100 wt. %, based on the total weight of the ceramic material 50. In yet another example embodiment, the ceramic material 50 includes ceria stabilized zirconia and yttria stabilized zirconia in a total amount of 90 to 100 wt. %, based on the total weight of the ceramic material 50. In another example embodiment, the ceramic material 50 includes magnesia stabilized zirconia, calcia stabilized zirconia, and/or zirconia stabilized by another oxide in an amount of 90 to 100 wt. %, based on the total weight of the ceramic material 50. In other words, any of the oxides can be used alone or in combination in an amount of 90 to 100 wt. %, based on the total weight of the ceramic material 50. In cases where the ceramic material 50 does not consist entirely of the ceria, ceria stabilized zirconia, yttria stabilized zirconia, magnesia stabilized zirconia, calcia stabilized zirconia, and/or zirconia stabilized by another oxide, the remaining portion of the ceramic material 50 typically consists of other oxides and compounds such as aluminum oxide, titanium oxide, chromium oxide, silicon oxide, manganese or cobalt compounds, silicon nitride, and/or functional materials such as pigments or catalysts. For example, according to one embodiment, a catalyst is added to the thermal barrier coating 22 to modify combustion. A color compound can also be added to the thermal barrier coating 22. According to one example embodiment, thermal barrier coating 22 is a tan color, but could be other colors, such as blue or red.

According to one embodiment, wherein the ceramic material 50 includes ceria stabilized zirconia, the ceramic material 50 includes the ceria in an amount of 20 wt. % to 25 wt. % and the zirconia in an amount of 75 wt. % to 80 wt. %, based on the total amount of ceria stabilized zirconia in the ceramic material 50. Alternatively, the ceramic material 50 can include up to 3 wt. % yttria, and the amount of zirconia is reduced accordingly. In this embodiment, the ceria stabilized zirconia is provided in the form of particles having a nominal particle size of 11 μm to 125 μm. Preferably, 90 wt. % of the ceria stabilized zirconia particles have a nominal particle size less than 90 μm, 50 wt. % of the ceria stabilized zirconia particles have a nominal particle size less than 50 μm, and 10 wt. % of the ceria stabilized zirconia particles have a nominal particle size less than 25 μm.

According to another example embodiment, wherein the ceramic material 50 includes yttria stabilized zirconia, the ceramic material 50 includes the yttria in an amount of 7 wt. % to 9 wt. %, and the zirconia in an amount of 91 wt. % to 93 wt. %, based on the amount of yttria stabilized zirconia in the ceramic material 50. In this embodiment, the yttria stabilized zirconia is provided in the form of particles having a nominal particle size of 11 μm to 125 μm. Preferably, 90 wt. % of the yttria stabilized zirconia particles have a nominal particle size less than 90 μm, 50 wt. % of the yttria stabilized zirconia particles have a nominal particle size less than 50 μm, and 10 wt. % of the yttria stabilized zirconia particles have a nominal particle size less than 25 μm.

According to another example embodiment, wherein the ceramic material 50 includes a mixture of ceria stabilized zirconia and yttria stabilized zirconia, the ceramic material 50 includes the ceria stabilized zirconia in an amount of 5 wt. % to 95 wt. %, and the yttria stabilized zirconia in an amount of 5 wt. % to 95 wt. %, based on the total amount of the mixture present in the ceramic material 50. In this embodiment, the ceria stabilized zirconia is provided in the form of particles having a nominal particle size of 11 μm to 125 μm. Preferably, 90 wt. % of the ceria stabilized zirconia particles have a particle size less than 90 μm, 50 wt. % of the ceria stabilized zirconia particles have a particle size less than 50 μm, and 10 wt. % of the ceria stabilized zirconia particles have a particle size less than 25 μm. The yttria stabilized zirconia is also provided in the form of particles having a nominal particle size of 11 μm to 125 μm. Preferably, 90 wt. % of the yttria stabilized zirconia particles have a particle size less than 109 μm, 50 wt. % of the yttria stabilized zirconia particles have a particle size less than 59 μm, and 10 wt. % of the yttria stabilized zirconia particles have a particle size less than 28 μm. When the ceramic material 50 includes the mixture of ceria stabilized zirconia and yttria stabilized zirconia, the ceramic material can be formed by adding 5 wt. % to 95 wt. % of ceria stabilized zirconia to the balance of yttria stabilized zirconia in the total 100 wt. % mixture.

According to yet another example embodiment, wherein the ceramic material 50 includes calcia stabilized zirconia, the ceramic material 50 includes the calcia in an amount of 4.5 wt. % to 5.5 wt. %, and the zirconia in an amount of 91.5 wt. %, with the balance consisting of other oxides in the ceramic material 50. In this embodiment, the calcia stabilized zirconia is provided in the form of particles having a nominal particle size range of 11 μm to 90 μm. Preferably, the calcia stabilized zirconia particles contain a maximum of 7 wt. % with particle size greater than 45 μm and up to 65 wt. % of particles less than 45 μm.

According to yet another example embodiment, wherein the ceramic material 50 includes magnesia stabilized zirconia, the ceramic material 50 includes the magnesia in an amount of 15 wt. % to 30 wt. %, with the balance consisting of zirconia. In this embodiment, the magnesia stabilized zirconia is provided in the form of particles having a nominal particle size of 11 μm to 90 μm. Preferably, 15 wt. % of the magnesia stabilized zirconia particles have a particle size less than 88 μm.

Other oxides or mixtures of oxides may be used to stabilize the ceramic material 50. The amount of other oxide or mixed oxides is typically in the range 5 wt. % to 38 wt. % and the nominal particle size range of the stabilized ceramic material 50 is 1 μm to 125 μm.

The porosity of the ceramic material 50 is typically controlled to reduce the thermal conductivity of the thermal barrier coating 22. When a thermal spray method is used to apply the thermal barrier coating 22, the porosity of the ceramic material 50 is typically less than 25% by vol., such as 2% by vol. to 25% by vol., preferably 5% by vol. to 15% by vol., and more preferably 8% by vol. to 10% by vol., based on the total volume of the ceramic material 50. However, if a vacuum method is used to apply the thermal barrier coating 22, then the porosity is typically less than 5% by vol., based on the total volume of the ceramic material 50. The porosity of the entire thermal barrier coating 22 can also be 2% by vol. to 25% by vol., but is typically greater than 5% by vol. to 25% by vol., preferably 5% by vol. to 15% by vol., and most preferably 8% by vol. to 10% by vol., based on the total volume of the thermal barrier coating 22. The pores of the thermal barrier coating 22 are typically concentrated in the ceramic regions. The porosity of the thermal barrier coating 22 contributes to the reduced thermal conductivity of the thermal barrier coating 22.

The thermal barrier coating 22 is also applied in a gradient structure 51 to avoid discrete metal/ceramic interfaces. In other words, the gradient structure 51 avoids sharp interfaces. Thus, the thermal barrier coating 22 is less likely to de-bond during service. The gradient structure 51 of the thermal barrier coating 22 is formed by first applying a metal bond material 52 to the component, followed by a mixture of the metal bond material 52 and ceramic material 50, and then the ceramic material 50.

The composition of the metal bond material 52 can be the same as the powder used to form the body portion 42 of the component, for example a steel powder. Alternatively the metal bond material 52 can comprise a high performance superalloy, such as those used in coatings of jet turbines. According to example embodiments, the metal bond material 52 includes or consists of at least one of alloy selected from the group consisting of CoNiCrAlY, NiCrAlY, NiCr, NiAl, NiCrAl, NiAlMo, and NiTi. The thermal barrier coating 22 typically includes the metal bond material 52 in an amount of 5% by vol. to 33% by vol. %, more preferably 10% by vol. to 33% by vol., most preferably 20% by vol. to 33% by vol., based on the total volume of the thermal barrier coating 22. The metal bond material 52 is provided in the form of particles having a particle size of −140 mesh 105 μm), preferably −170 mesh 90 μm), more preferably −200 mesh 74 μm), and most preferably −400 mesh (<37 μm). According to one example embodiment, the thickness of the metal bond material 52 ranges from 30 microns to 1 mm. The thickness limit of the metal bond material 52 is dictated by the particle size of the metal bond material 52. A low thickness is oftentimes preferred to reduce the risk of delamination of the thermal barrier coating 22.

The gradient structure 51 is formed by gradually transitioning from 100% metal bond material 52 to 100% ceramic material 50. The thermal barrier coating 22 includes the metal bond material 52 applied to the body portion 26, followed by increasing amounts of the ceramic material 50 and reduced amounts of the metal bond material 52. The transition function of the gradient structure 51 can be linear, exponential, parabolic, Gaussian, binomial, or could follow another equation relating composition average to position.

The uppermost portion of the thermal barrier coating 22 is formed entirely of the ceramic material 50. The gradient structure 51 helps to mitigate stress build up through thermal mismatches and reduces the tendency to form a continuous weak oxide boundary layer at the interface of the ceramic material 50 and the metal bond material 52.

Figures 4, 5A:
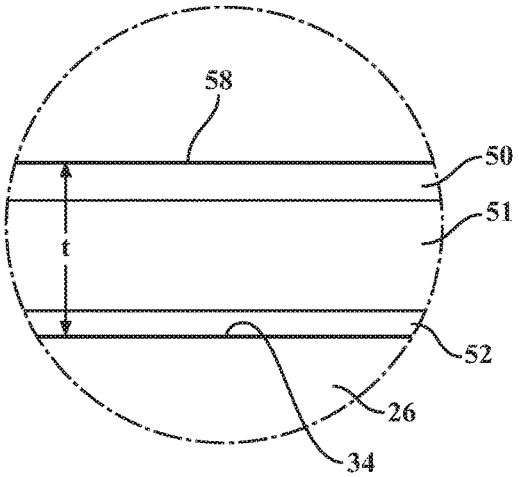
FIG. 4 is an enlarged cross-sectional view showing an example of the thermal barrier coating disposed on the cylinder liner.
Figure 6:
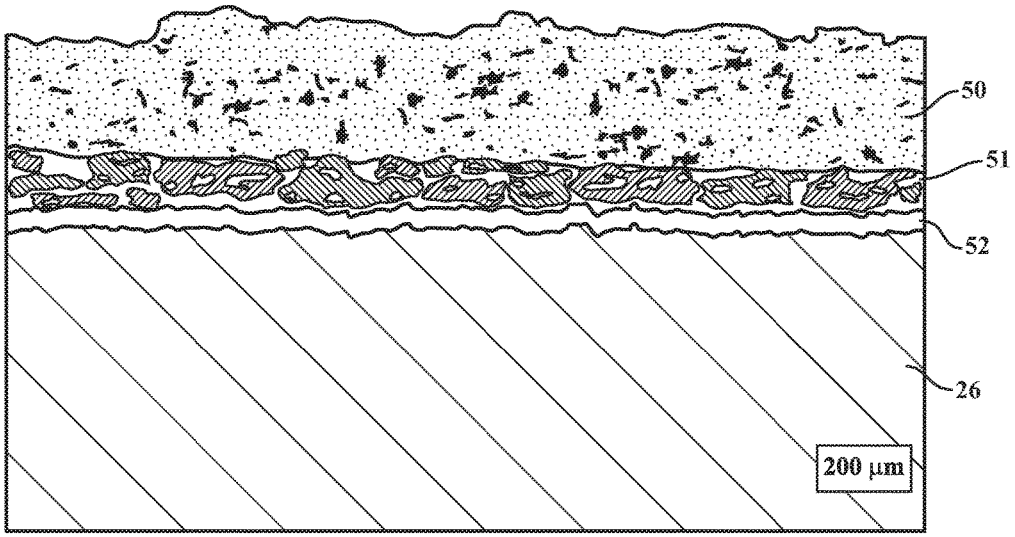
FIG. 6 is a cross-sectional view showing an example of the thermal barrier coating disposed on a steel component.

According to one embodiment, as shown in FIG. 4, the lowermost portion of the thermal barrier coating 22 applied directly to the surface of the body portion 42, such as the inner diameter surface 38 of the cylinder liner 28, consists of the metal bond material 52. Typically, 5% to 20% of the entire thickness of the thermal barrier coating 22 is formed of 100% metal bond material 52. In addition, the uppermost portion of the thermal barrier coating 22 can consist of the ceramic material 50. For example, 5% to 50% of the entire thickness of the thermal barrier coating 22 could be formed of 100% ceramic material 50. The gradient structure 51 of the thermal barrier coating 22 which continuously transitions from the 100% metal bond material 52 to the 100% ceramic material 50 is located therebetween. Typically, 30% to 90% of the entire thickness of the thermal barrier coating 22 is formed of, or consists of, the gradient structure 51. It is also possible that 10% to 90% of the entire thickness of the thermal barrier coating 22 is formed of a layer of the metal bond layer 52, up to 80% of the thickness of the thermal barrier coating 22 is formed of the gradient structure 51, and 10% to 90% of the entire thickness of the thermal barrier coating 22 is formed of a layer of the ceramic material 50. FIG. 4 is an enlarged cross-sectional view showing an example of the thermal barrier coating 22 disposed on the inner diameter surface 38 of the cylinder liner 28. Example compositions of the thermal barrier coating 22 including ceria stabilized zirconia (CSZ), yttria stabilized zirconia (YSZ), and metal bond material (Bond) are disclosed in FIG. 5. FIG. 6 is a cross-sectional view showing an example of the thermal barrier coating 22 disposed on the steel body portion 42.

In its assprayed form, the thermal barrier coating 22 typically has a surface roughness Ra of less than 15 μm, and a surface roughness Rz of not greater than ≤110 μm. The thermal barrier coating 22 can be smoothed. At least one additional metal layer, at least one additional layer of the metal bonding material 52, or at least one other layer, could be applied to the outermost surface of the thermal barrier coating 22. When the additional layer or layers are applied, the outermost surface formed by the additional material could also have the surface roughness Ra of less than 15 μm, and a surface roughness Rz of not greater than <110 μm. Roughness can affect combustion by trapping fuel in cavities on the surface of the coating. It is desirable to avoid coated surfaces rougher than the examples described herein.

The thermal barrier coating 22 has a low thermal conductivity to reduce heat flow through the thermal barrier coating 22. Typically, the thermal conductivity of the thermal barrier coating 22 having a thickness of less than 1 mm, is less than 1.00 W/m·K, preferably less than 0.5 W/m·K, and most preferably not greater than 0.23 W/m·K. The specific heat capacity of the thermal barrier coating 22 depends on the specific composition used, but typically ranges from 480 J/kg·K to 610 J/kg·K at temperatures between 40 and 700° C. The low thermal conductivity of the thermal barrier coating 22 is achieved by the relatively high porosity of the ceramic material 50. Due to the composition and low thermal conductivity of the thermal barrier coating 22, the thickness of the thermal barrier coating 22 can be reduced, which reduces the risk of cracks or spalling, while achieving the same level of insulation relative to comparative coatings of greater thickness. It is noted that the advantageous low thermal conductivity of the thermal barrier coating 22 is not expected. When the ceramic material 50 of the thermal barrier coating 22 includes ceria stabilized zirconia, the thermal conductivity is especially low.

The bond strength of the thermal barrier coating 22 is also increased due to the gradient structure 51 present in the thermal barrier coating 22 and the composition of the metal used to form the component. The bond strength of the thermal barrier coating 22 having a thickness of 0.38 mm is typically at least 2000 psi when tested according to ASTM C633.

The thermal barrier coating 22 with the gradient structure 51 can be compared to a comparative coating having a two layer structure, which is typically less successful than the thermal barrier coating 22 with the gradient structure 51. The comparative coating includes a metal bond layer applied to a metal substrate followed by a ceramic layer with discrete interfaces through the coating. In this case, combustion gases can pass through the porous ceramic layer and can begin to oxidize the bond layer at the ceramic/bond layer interface. The oxidation causes a weak boundary layer to form, which harms the performance of the coating.

However, the thermal barrier coating 22 with the gradient structure 51 can provide numerous advantages. The thermal barrier coating 22 is applied to at least a portion of the surface of the component exposed to the combustion chamber 24 or the exhaust gas generated by the internal combustion engine 20 to provide a reduction in heat flow through the component. The reduction in heat flow is typically at least 50%, relative to the same component without the thermal barrier coating 22. By reducing heat flow through the component, more heat is retained in the fuel-air mixture of the combustion chamber and/or exhaust gas produced by the engine, which leads to improved engine efficiency and performance.

The thermal barrier coating 22 of the present invention has been found to adhere well to the steel body portion 42. However, for additional mechanical anchoring, the surfaces of the body portion 42 to which the thermal barrier coating 22 is applied is typically free of any edge or feature having a radius of less than 0.1 mm. In other words, the surfaces of the component to which the thermal barrier coating 22 is preferably free of any sharp edges or corners. According to one example embodiment, the body portion 42 includes a broken edge or chamfer machined along its surface. The chamfer allows the thermal barrier coating 22 to radially lock to the body portion 42. Alternatively, at least one pocket, recess, or round edge could be machined along the surface of the body portion 42. These features help to avoid stress concentrations in the thermal sprayed coating 22 and avoid sharp corners or edges that could cause coating failure. The machined pockets or recesses also mechanically lock the coating 22 in place, again reducing the probability of delamination failure.

Another aspect of the invention provides a method of manufacturing the coated component for use in the internal combustion engine 20, for example a diesel engine. The component, which is typically formed of steel, can be manufactured according to various different methods, such as forging, casting, and/or welding. As discussed above, the thermal barrier coating 22 can be applied to various different components exposed to the combustion chamber 24 or the exhaust gas generated by the internal combustion engine 20, and those components can comprise various different designs. Prior to applying the thermal barrier coating 22 to the body portion 42, any phosphate or other material located on the surface to which the thermal barrier coating 22 is applied must be removed.

The method next includes applying the thermal barrier coating 22 to the body portion 42 of the component. The thermal barrier coating 22 can be applied to the entire surface of the component exposed to the combustion chamber or the exhaust gases, or only a portion of that surface. The ceramic material 50 and metal bond material 52 are provided in the form of particles or powders. The particles can be hollow spheres, spray dried, spray dried and sintered, sol-gel, fused, and/or crushed. For example, as shown in FIGS. 1-3, the thermal barrier coating 22 is applied to the portion of the cylinder liner 28 and the valve face 36.

In the example embodiment, the method includes applying the metal bond material 52 and the ceramic material 50 by a thermal or kinetic method. According to one embodiment, a thermal spray technique, such as plasma spraying, flame spraying, or wire arc spraying, is used to form the thermal barrier coating 22. High velocity oxy-fuel (HVOF) spraying is a preferred example of a kinetic method that gives a denser coating. Other methods of applying the thermal barrier coating 22 to the component can also be used. For example, the thermal barrier coating 22 could be applied by a vacuum method, such as physical vapor deposition or chemical vapor deposition. According to one embodiment, HVOF is used to apply a dense layer of the metal bond material 52 to the component, and a thermal spray technique, such as plasma spray, is used to apply the gradient structure 51 and the layer of ceramic material 50. Also, the gradient structure 51 can be applied by changing feed rates of twin powder feeders while the plasma sprayed coating is being applied.

The example method begins by spraying the metal bond material 52 in an amount of 100 wt. % and the ceramic material 50 in an amount of 0 wt. %, based on the total weight of the materials being sprayed. Throughout the spraying process, an increasing amount of ceramic material 50 is added to the composition, while the amount of metal bond material 52 is reduced. Thus, as shown in FIG. 4, the composition of the thermal barrier coating 22 gradually changes from 100% metal bond material 52 along the component to 100% ceramic material 50 at a top surface 58 of the thermal barrier coating 22. Multiple powder feeders are typically used to apply the thermal barrier coating 22, and their feed rates are adjusted to achieve the gradient structure 51. The gradient structure 51 of the thermal barrier coating 22 is achieved during the thermal spray process.

The thermal barrier coating 22 can be applied to the entire component, or a portion thereof, for example only the surface exposed to the combustion chamber 24 or exhaust gas, or only a portion of that surface. Non-coated regions of the component can be masked during the step of applying the thermal barrier coating 22. The mask can be a re-usable and removal material applied adjacent the region being coated. Masking can also be used to introduce graphics in the thermal barrier coating 22. In addition, after the thermal barrier coating 22 is applied, the coating edges are blended, and sharp corners or edges are reduced to avoid high stress regions.

As shown in FIG. 4, the thermal barrier coating 22 has a thickness t extending from the surface of the body portion 42 of the component, for example the inner diameter surface 38 of the cylinder liner 28, to the top surface 58. According to example embodiments, the thermal barrier coating 22 is applied to a total thickness t of not greater than 1.0 mm, or not greater than 0.7 mm, preferably not greater than 0.5 mm, and most preferably not greater than 0.380 mm. In the example embodiment of FIGS. 1 and 2, the total thickness t of the thermal barrier coating 22 disposed along the inner diameter surface 38 of the cylinder liner 28 is 0.380 mm. This total thickness t preferably includes the total thickness of the thermal barrier coating 22 and also any additional or sealant layer applied to the uppermost surface of the thermal barrier coating 22. However, the total thickness t could be greater when the additional layers are used.

The thickness t can be uniform along the entire surface of the component, but typically the thickness t varies along the surface of the component, especially if the surface has a complex shape. In certain regions of the component, for example where the component is subject to less heat and pressure, the thickness t of the thermal barrier coating 22 can be as low as 0.020 mm to 0.030 mm. In other regions of the component, for example regions which are subjected to the highest temperatures and pressures, the thickness t of the thermal barrier coating 22 is increased. For example, the method can include aligning the component 20 in a specific location relative to the spray gun and fixture, fixing the component to prevent rotation, using a scanning spray gun in a line, and varying the speed of the spray or other technique used to apply the thermal barrier coating 22 to adjust the thickness t of the thermal barrier coating 22 over different regions of the component.

In addition, more than one layer of the thermal barrier coating 22, such as 5-10 layers, having the same or different compositions, could be applied to the component. Furthermore, coatings having other compositions could be applied to the component in addition to the thermal barrier coating 22. According to one example embodiment, an additional metal layer, such as an electroless nickel layer, is applied over the thermal barrier coating 22 to provide a seal against fuel absorption, prevent thermally grown oxides, and prevent chemical degradation of the ceramic material 50. The thickness of the additional metal layer is preferably from 1 to 50 microns. If the additional metal layer is present, the porosity of the thermal barrier coating 22 could be increased. Alternatively, an additional layer of the metal bonding material 52 can be applied over the ceramic material 50 of the thermal barrier coating 22.

Prior to applying the thermal barrier coating 22, the surface of the component to which the thermal barrier coating 22 is applied is washed in solvent to remove contamination. Next, the method typically includes removing any edge or feature having a radius of less than 0.1 mm. The method can also include forming the broken edges or chamfer 56, or another feature that aids in mechanical locking of the thermal barrier coating 22 to the component and reduce stress risers, in the component. These features can be formed by machining, for example by turning, milling or any other appropriate means. The method can also include grit blasting surfaces of the component prior to applying the thermal barrier coating 22 to improve adhesion of the thermal barrier coating 22.

After the thermal barrier coating 22 is applied to the component, the coated component can be abraded to remove asperities and achieve a smooth surface. In the example embodiment of FIGS. 1 and 2, the thermal barrier coating 22 applied to the cylinder liner 28 requires post-finishing, for example by machining or honing. The method can also include forming a marking on the surface of the thermal barrier coating 22 for the purposes of identification of the coated component when the component is used in the market. The step of forming the marking typically involves re-melting the thermal barrier coating 22 with a laser. According to other embodiments, an additional layer of graphite, thermal paint, or polymer is applied over the thermal barrier coating 22. If the polymer coating is used, the polymer burns off during use of the component in the engine 20. The method can include additional assembly steps, such as washing and drying, adding rust preventative and also packaging. Any post-treatment of the coated component must be compatible with the thermal barrier coating 22.

Obviously, many modifications and variations of the present invention are possible in light of the above teachings and may be practiced otherwise than as specifically described while within the scope of the following claims.

The invention claimed is:

1. A component for exposure to a combustion chamber of an internal combustion engine and/or exhaust gas generated by the internal combustion engine, comprising:

a body portion formed of metal;

a thermal barrier coating applied to said body portion;

said thermal barrier coating including a mixture of a metal bond material and a ceramic material;

and wherein said ceramic material of said thermal barrier coating includes ceria stabilized zirconia.

2. The component of claim 1, wherein a porosity of said ceramic material is 2% by vol. to 25% vol., based on the total volume of said ceramic material.

3. The component of claim 1, wherein said thermal barrier coating has a thickness extending from said body portion to a top surface, and said thickness of said thermal barrier coating is less than 1 mm.

4. The component of claim 1, wherein said thermal barrier coating has a thermal conductivity of less than 1.00 W/m·K.

5. The component of claim 1, wherein said thermal barrier coating includes a layer of said metal bond material applied directly to said body portion formed of metal, said thermal barrier coating has a thickness extending from said body portion to a top surface, and 5% to 20% of said thickness of said thermal barrier coating consists of said layer of metal bond material;

said thermal barrier coating includes a gradient structure applied directly to said layer of metal bond material, said gradient structure includes said mixture of said metal bond material and said ceramic material, the amount of said ceramic material present in said gradient structure increases continuously from said first layer toward said top surface; and said thermal barrier coating includes a layer of said ceramic material applied directly to said gradient structure and extending to said top surface, and 5% to 50% of said thickness of said thermal barrier coating consists of said layer of said ceramic material.

6. The component of claim 1, wherein said metal bond material includes at least one alloy selected from the group consisting of CoNiCrAlY, NiCrAlY, NiCr, NiAl, NiCrAl, NiAlMo, and NiTi.

7. The component of claim 1, wherein a surface of said body portion to which said thermal barrier coating is applied is free of any feature having a radius of less than 0.1 mm.

8. The component of claim 1, wherein said thermal barrier coating applied to a surface of said body portion has a bond strength of at least 2000 psi when tested according to ASTM C633.

9. The component of claim 1, wherein said thermal barrier coating is applied to a surface of said body portion exposed to said combustion chamber and/or said exhaust gas, and said thermal barrier coating is applied a first portion of said surface and not applied to a second portion of said surface.

10. The component of claim 1, wherein said component is selected from the group consisting of a cylinder liner, a cylinder head, a fuel injector, a valve seat, and a valve face.

11. The component of claim 10, wherein said component is said cylinder liner, said cylinder liner includes an inner diameter surface, and said thermal barrier coating is applied to a first portion of said inner diameter surface located opposite a top land of a piston when the piston is located at top dead center and not applied to a second portion of said inner diameter surface located below said first portion.

12. The method of claim 11, wherein the ceramic material of the thermal barrier coating has a porosity of 2% by vol. to 25% vol., based on the total volume of the ceramic material, the thermal barrier coating has a thickness extending from the body portion to a top surface, the thickness of the thermal barrier coating is less than 1 mm, and the thermal barrier coating has a thermal conductivity of less than 1.00 W/m·K.

13. The component of claim 11, wherein said inner diameter surface of said cylinder liner includes a groove, and said thermal barrier coating is disposed in said groove.

14. The component of claim 1, wherein said component is selected from the group consisting of a valvetrain, a surface of a post-combustion chamber, an exhaust manifold, and a turbocharger.

15. The component of claim 1, wherein said thermal barrier coating extends from said body portion to a top surface, and the amount of ceramic material present in said thermal barrier coating increases from said body portion to said top surface.

16. A method of manufacturing a component for exposure to a combustion chamber of an internal combustion engine and/or exhaust gas generated by the internal combustion engine, comprising:

applying a thermal barrier coating to a body portion formed of metal, the thermal barrier coating including a mixture of a metal bond material and a ceramic material;

and wherein the ceramic material of the thermal barrier coating includes at least one of coria, ceria stabilized zirconia.

17. The method of claim 16, wherein the thermal barrier coating is applied by a thermal spray technique.

18. The method of claim 16, wherein at least a portion of the thermal barrier coating is applied by high velocity oxy-fuel (HVOF) spraying.

19. The method of claim 16, wherein the ceramic material is provided as particles before applying to the body portion, and the particles of ceramic material have a nominal particle size of 11 μm to 125 μm; the metal bond material is provided as particles before applying to the body portion, and the particles of the metal bond material have a nominal particle size of less than 105 μm.

20. The method of claim 16, wherein the thermal barrier coating has a thickness extending from the body portion to a top surface, and the step of applying the thermal barrier coating to the body portion includes increasing the amount of ceramic material relative to the metal bond material from the body portion to the top surface.

21. A component for exposure to a combustion chamber of an internal combustion engine and/or exhaust gas generated by the internal combustion engine, comprising:

a body portion formed of metal;

a thermal barrier coating applied to said body portion;

said thermal barrier coating including a mixture of a metal bond material and a ceramic material;

wherein said ceramic material of said thermal barrier coating includes ceria stabilized zirconia; and an additional metal layer applied to said mixture of said metal bond material and said ceramic material.

22. The component of claim 21, wherein said additional metal layer includes nickel.

23. The component of claim 21, wherein said additional layer has a thickness of 1 to 50 microns.

24. A component for exposure to a combustion chamber of an internal combustion engine and/or exhaust gas generated by the internal combustion engine, comprising:

a body portion formed of metal;

a thermal barrier coating applied to said body portion;

said thermal barrier coating including a mixture of a metal bond material and a ceramic material;

wherein said ceramic material of said thermal barrier coating includes ceria stabilized zirconia; and said thermal barrier coating having a thickness of not greater than 0.5 mm.

25. The component of claim 24, wherein the thermal barrier coating has a thickness of not greater than 0.38 mm.

26. A method of manufacturing a component for exposure to a combustion chamber of an internal combustion engine and/or exhaust gas generated by the internal combustion engine, comprising:

applying a thermal barrier coating to a body portion formed of metal, the thermal barrier coating including a mixture of a metal bond material and a ceramic material; and the step of applying the thermal barrier coating to the body portion including applying an additional metal layer to the mixture of the metal bond material and the ceramic material, wherein the ceramic material of the thermal barrier coating includes stabilized zirconia.

27. A method of manufacturing a component for exposure to a combustion chamber of an internal combustion engine and/or exhaust gas generated by the internal combustion engine, comprising:

applying a thermal barrier coating to a body portion formed of metal, the thermal barrier coating including a mixture of a metal bond material and a ceramic material, wherein the ceramic material of the thermal barrier coating includes ceria stabilized zirconia; and the step of applying the thermal barrier coating to the crown including applying the thermal barrier coating to a thickness of not greater than 0.5 mm.

28. The method of claim 27, wherein the step of applying the thermal barrier coating to the body portion includes applying the thermal barrier coating to a thickness of not greater than 0.38 mm.

* * * * *